US005107241A

United States Patent [19]

Ubukata et al.

[11] Patent Number: 5,107,241

[45] Date of Patent: Apr. 21, 1992

[54] THERMALLY RESPONSIVE SWITCH

[75] Inventors: Susumu Ubukata; Yasukazu Mizutani, both of Nagoya, Japan

[73] Assignee: Susumu Ubukata, Nagoya, Japan

[21] Appl. No.: 630,964

[22] Filed: Dec. 24, 1990

[30] Foreign Application Priority Data

Dec. 26, 1989 [JP] Japan ..... 1-338002

[51] Int. Cl.[5] ..... H01H 37/12; H01H 37/54

[52] U.S. Cl. ..... 337/368; 337/377

[58] Field of Search ..... 337/94, 57, 347, 349, 337/360, 368, 377, 82

[56] References Cited

U.S. PATENT DOCUMENTS 3,538,478 11/1970 D'Entremont et al. .

4,672,353 6/1987 Ubukata et al. ..... 337/368

4,843,363 6/1989 Ubukata et al. ..... 337/368

*Primary Examiner*—Harold Broome

*Attorney, Agent, or Firm*—Foley & Lardner

[57] ABSTRACT

A thermal motor protector includes a first support for supporting a thermally responsive element and a second support for supporting a fixed contact. The first and second supports are mounted on and insulated from a header plate. The thermally responsive element is secured to the first support through a fixing strip and has a central shallow dish-shaped portion and carries a movable contact at its distal end. A calibration mechanism includes a male screw, a hole formed in the first support and elastically slender clamping portions clamping the screw when it is screwed into the hole. The diameter of the hole is smaller than the outer diameter of the screw. The stiffness of the fixing strip is determined so that variations in the ratio of the current bypassed into the calibration mechanism to the current flowing through the fixing strip and thermally responsive element can be substantially ignored.

6 Claims, 3 Drawing Sheets

THERMALLY RESPONSIVE SWITCH

BACKGROUND OF THE INVENTION

This invention relates to a thermally responsive switch which is used as a thermal protector for protecting electric motors or the like against overcurrent and overheating conditions and includes a bimetallic or trimetallic thermally responsive element having a dish-shaped portion which reverses its curvature with a snap action in response to heat and a pair of contacts for making and breaking an electrical circuit upon the snap action of the thermally responsive element.

A motor protecting thermally responsive switch of the above-mentioned type is disclosed in Japanese Published Patent Application (Kokoku) No. 49-24744 corresponding to U.S. Pat. No. 3,538,478. This publication does not disclose the operating temperature calibrating mechanism for adjusting a contact pressure between a movable contact secured to a moving end of a bimetallic thermally responsive element and a fixed contact secured to a contact arm. Furthermore, the thermally responsive element is positioned in an assembly by way of welding so that the contact pressure necessary for calibrating the operating temperature of the element is in a predetermined range. In the case where the thermally responsive element is not suitably positioned in the assembly, there is no way to suitably position it except by bending the contact arm to which the fixed contact is secured. However, such bending causes a spring back action, resulting in variations in the operating characteristics of the switches.

Japanese Laid-open Patent Application (Kokai) No. 62-88232 corresponding to U.S. Pat. No. 4,672,353 assigned to the same assignee as the present application discloses a snap-action type thermally responsive switch provided with a calibrating mechanism. In this calibrating mechanism, a first receiving portion engages the generally central portion of a thermally responsive element. One end of the thermally responsive element is secured to a strip which is further secured to a second receiving portion of a support for supporting the thermally responsive element. The thermally responsive element carries at the other end a movable contact which is engaged with a fixed contact. An elastic plate is provided between the thermally responsive element and the support. Thus, the construction of the thermally responsive switch disclosed is complicated. Accordingly, when an overcurrent sufficient to operate the thermally responsive switch flows in the circuit and a sufficiently high temperature to reverse the thermally responsive element is reached, a series combination of the elastic plate and thermally responsive element is connected in parallel to the calibration mechanism such that the current is caused to flow into a bypass circuit between the first receiving portion contacting the approximately central portion of the thermally responsive element and the distal end of the thermally responsive element to which end the movable contact is fixed. Furthermore, since the contact pressure between the first receiving portion and the approximately central portion of the thermally responsive element changes in the increasing temperature stage of the thermally responsive element, the resistance of the bypass circuit also varies. Consequently, since the value of composite resistance of the internal circuit of the thermally responsive switch varies, the current versus operating time characteristic of the switches differs from product to product. The current versus operating time characteristic here refers to the characteristic in accordance with which the thermally responsive switch must operate to protect the motor or the like within a predetermined time against overcurrent of a preselected value in the same atmosphere. For example, when the reference response time is 10 seconds in the case where the current of 30 amperes flows at 25° C., the response time is 8 seconds for one occasion and 15 seconds for another occasion even in the same product. Particularly, the variations in the current versus operating time characteristic become increased in case of mass production of the thermally responsive switches, resulting in inconsistency as a protecting device. In order to prevent such an inconsistency, a mechanism is necessary for electrically insulating the contact portion where the first receiving portion contacts the central portion of the thermally responsive element and the contact portion where the second receiving portion contacts the connecting strip secured to one end of the thermally responsive element, which complicates the construction of the thermally responsive switch.

SUMMARY OF THE INVENTION

Therefore, an object of the present invention is to provide a thermally responsive switch having a simple construction, an operating temperature calibrating mechanism providing a high degree of accuracy, and no variations in the current versus operating time characteristic.

Another object of the present invention is to provide a thermally responsive switch having a particular construction designed to achieve the above-mentioned object.

The present invention provides a thermally responsive switch comprising a header plate formed of an electrically conductive material and having two openings through which terminal pins are extended and secured therein with an insulating material placed therebetween, respectively A first support formed of a conductive material is secured to one of two ends of one terminal pin. The first support has a predetermined value of stiffness. A fixing strip is secured at one end to the vicinity of a portion of the first support secured to the terminal pin. A thermally responsive element is secured at one of two ends to the other end of the fixing strip in a cantilever relation. The thermally responsive element has a generally central dish-shaped portion moving with a snap action when subjected to heat. The thermally responsive element carries a movable contact at the other end. A second support is secured to the other terminal p in and has a fixed contact. Furthermore, a calibration mechanism is provided on the first support. The calibration mechanism includes a generally rectangular male screw clamping portion usually clamping the screw elastically when the screw is screwed into a hole having an inner diameter smaller than the outer diameter of the screw. The stiffness of the fixing strip is previously selected so that variations in the ratio of the current bypassing into the calibration mechanism to the current flowing through the fixing strip and thermally responsive element can be substantially ignored. Preferably, a heater may be provided in the above-described construction. In this case, one end of the heater is secured to the vicinity of a portion of the first support secured to the terminal pin and the other end is connected to the header plate.

In accordance with the invention, since a calibration mechanism with a high level of accuracy is provided in the first support for reversing with a snap action the thermally responsive element at a preselected temperature, the slender portions of the first support clamping the screw can provide a high resistance value. The contact pressure between the movable contact secured to one end of the thermally responsive element and the fixed contact is adjusted by causing the fixing strip to move away from and come close to the first support by way of the screw. Since the fixing strip has a stiffness sufficient to support its secured end side of the thermally responsive element, the variations in the resistance value of the calibration mechanism including the contact position thereof as the bypass for the current flowing through the fixing strip may be rendered so small as to be ignored. More specifically, the contact pressure applied by the male screw to the fixing strip is a composite of a force necessary for deforming the fixing strip and a reaction force of the contact pressure between the fixed contact and the movable contact carried by the thermally responsive element supported via the fixing strip. The contact pressure between the thermally responsive element and the fixed contact depends upon the ambient temperature. When the ambient temperature comes close to the switch operating temperature, the contact pressure between the moving and fixed contacts approximates zero. However, since the residual force is sufficient for the screw to deform the fixing strip, the contact resistance due to the residual force approximates the contact resistance when the screw deforms the fixing strip to hold it at the predetermined position, the contact resistance including the reaction force when the contact resistance between the thermally responsive element and the fixed contact is sufficiently large. Furthermore, a large resistance value is readily obtained by the slender portions clamping the screw, as described above. Consequently, the ratio of the current bypassing into the calibration mechanism to the current flowing through the fixing strip and thermally responsive element can be reduced to a small value. Accordingly, the variations in the composite resistance value of the calibration mechanism and the fixing strip can be ignored.

Preferably, either one of the first and second supports may be secured to one terminal pin and the other may be fixed to the header plate. In this case, the other terminal pin may be removed. Alternatively, when the other terminal pin is employed, the heater may be connected to the terminal pin.

Other objects of the invention will become obvious from an understanding of the illustrative embodiment about to be described or as indicated in the appended claims. Various advantages not referred to herein will occur to one skilled in the art upon employment of the invention in practice.

DESCRIPTION OF THE PREFERRED EMBODIMENTS

Figure 1:
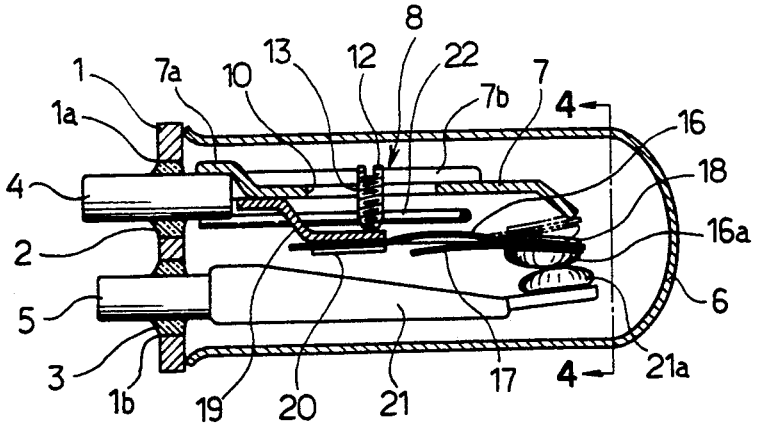
FIG. 1 is a longitudinal section of the thermally responsive switch of an embodiment of the invention.
Figure 2:
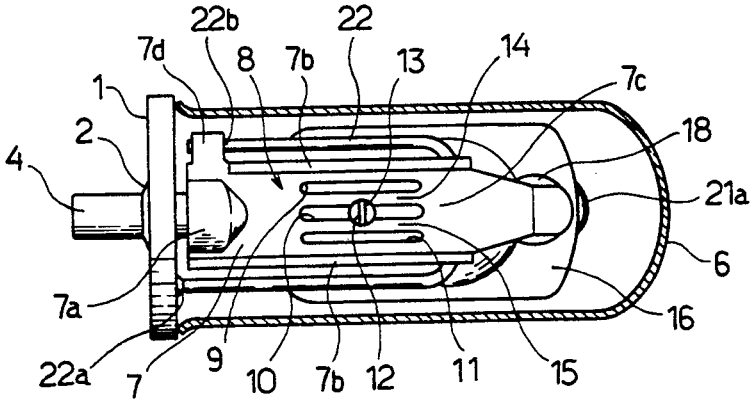
FIG. 2 is transverse sectional plan view of the thermally responsive switch.
Figure 3:
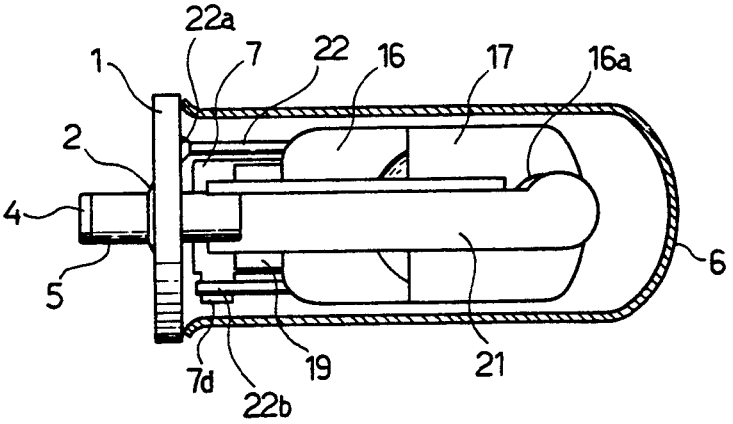
FIG. 3 is a transverse sectional bottom view of the thermally responsive switch.
Figure 4:
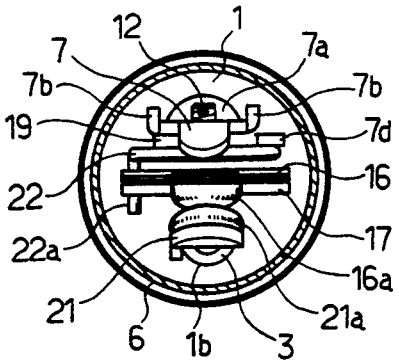
FIG. 4 is a sectional view taken along line 4—4 in FIG. 1.

A first embodiment of the present invention will now be described with reference to FIGS. 1 to 6 of the drawings.

Referring to FIGS. 1 to 4, a circular header plate 1 is formed of an electrically conductive material such as a thick steel plate. Two holes 1*a* and 1*b* are formed in the header plate 1. Terminal pins 4 and 5 each formed of, for example, an Fe-Ni alloy are placed through the respective holes 1*a*, 1*b* and hermetically secured in position by electrical insulation materials 2 and 3 such as glass. A housing 6 formed of a steel plate by way of deep drawing is secured to the vicinity of the outer circumference of the header plate 1 by ring projection welding at the final stage of assembly. A first support 7 formed, for example, a rolled steel sheet is disposed in the housing 6 for supporting a thermally responsive element which will be described later. The first or thermally responsive element support 7 has at the left-hand end a dome-shaped support portion 7*a* secured to the terminal pin 4 by way of spot welding and extends to the right, as viewed in FIGS. 1, 2. The first support 7 also has ribs 7*b* extended lengthwise at both sides thereof for the purpose of increasing the stiffness thereof. Each rib is bent approximately at right angles to the horizontal plane of the support 7 as viewed in FIG. 1.

The thermally responsive element support 7 is provided with a calibration mechanism 8 including three slender openings 9, 10 and 11 formed in the central flat portion 7*c* of the support 7 and an arc-shaped portion 13 formed in the approximately central portion of the opening 10. A male screw 12 such as a stud bolt is screwed into the arc-shaped portion 13. Preferably, the diameter of the arc portion 13 is smaller than the outer or thread diameter of the male screw 12 and larger than the core diameter of the same. Furthermore, it is preferable that the male screw 12 have a hardness higher than that of the arc-shaped portion 13. Accordingly, when the male screw 12 is screwed into the arc-shaped portion 13, it forms a female screw on the inner surface of the arc-shaped portion 13. As can be understood from FIG. 2, the driving force and self-locking force of the male screw 12 may be set to respective desirable values by selecting the dimensions of the two clamping portions 14 and 15 formed by the openings 9–11.

Figure 5:
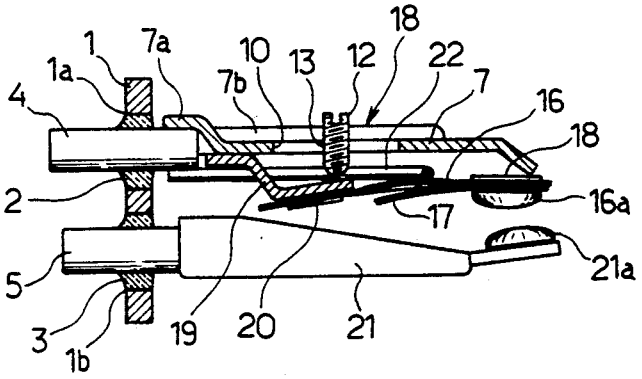
FIG. 5 is a view similar to FIG. 1 showing the thermally responsive switch in a stage of an assembly step.

A bimetallic or trimetallic thermally responsive element 16 has a generally central shallow dish-shaped portion. One side of the thermally responsive element 16 having a higher thermal expansion coefficient (the underside in FIG. 1) is concave and the other side (upper side in FIG. 1) thereof having a lower thermal expansion coefficient is convex at room temperature. A movable contact 16*a* formed from silver or any silver alloy is secured to a right-hand end of the thermally responsive element 16 by way of spot welding or the like, as viewed in FIG. 1. An arc barrier 17 formed of a thin nickel sheet is disposed between the thermally responsive element 16 and the movable contact 16a for protecting the thermally responsive element 16 against arcing. A reinforcing strip 18 is attached to the upper surface of the thermally responsive element 16 so that stress is prevented from being concentrated upon the welded portion of the movable contact 16a, thereby increasing the strength of the thermally responsive element 16. A fixing strip 19 is formed of a material having a suitable specific resistance in accordance with an operating current of the thermally responsive switch, such as rolled steel plate or nichrome steel plate. The left-hand fixed end of the thermally responsive element 16 is sandwiched between the right-hand end of the fixing strip 19 and another circular reinforcing strip 20 formed by a punched steel plate and secured therebetween by way of spot welding, as viewed in FIG. 1. The left-hand end of the fixing strip 19 is secured to the underside of the thermally responsive element support 7, as shown in FIG. 1. The lower end of the screw 12 is yet not brought into contact with the fixing strip 19 yet when the left-hand end of the strip 19 is welded to the vicinity of the base portion of the support 7. At this stage, it is preferable that the right-hand end of the fixing strip 19 be inclined obliquely upward in its free state, as shown in FIG. 5. A fixed contact 21a is formed from silver or a silver alloy as is the movable contact 16a and secured to the vicinity of the distal end of a second or fixed contact support 21. The fixed contact support 21 is formed of metal plate having a specific resistance in accordance with the operating current of the thermally responsive switch. The left-hand end of the fixed contact support 21 is rigidly secured to the terminal pin 5 by way of welding or the like. The fixed contact support 21 is bent at a right angle as in an angle steel member so that the strength thereof is increased. A slender generally U-shaped heater 22 is welded at one 22a to the header plate 1 and secured at the other end 22b to the vicinity of the base portion 7d of the thermally responsive element support 7.

In the thermally responsive switch constructed as described above, when further screwed into the arc portion 13 from the state shown in FIG. 5, the male screw 12 is brought into contact with the right-hand end of the fixing strip 19. When the right-hand end of the fixing strip 19 is further lowered so as to be located away from the support 7, thermally responsive element 16 secured to the right-hand end of the fixing strip 19 is displaced to the position shown in FIG. 1 with the right-hand side of the element 16 lowered. The contact pressure is sufficiently increased in this state so that the movable contact secured to the moving end of the thermally responsive element 16 is engaged with the fixed contact 21a at the room temperature. When the operating temperature of the thermally responsive element 16 is 150° C., for example, the dish-shaped portion of the solid thermally responsive element is so formed as to reverse its curvature at 160° C. When the male screw 12 is further screwed in with the temperature at approximately 150 ° C., the thermally responsive element 16 reverses its curvature in a snap action, occupying the position shown in a dotted line in FIG. 1. The calibration of the operating temperature is thus completed. However, when the operating temperature is lower than the predetermined one as the result of rechecking, the male screw 12 is returned so that the fixing strip 19 comes nearer to the first support 7.

In accordance with the above-described embodiment, the operating temperature of the thermally responsive switch can be accurately calibrated with ease when the amount of advance of the male screw 12 relative to the rotational angle thereof is reduced or when the male screw 12 has a fine pitch. Furthermore, since the male screw 12 is thrust into the arc-shaped portion 13, forming the internal thread, the male screw 12 is not loose. Additionally, since the male screw 12 is clamped by the clamping portions 14, 15, the screw 12 can be prevented from loosening. Furthermore, in the temperature range between 20° C. which is a lower value in the temperature range in which the movable contact 16a is engaged with the fixed contact 21a and 150° C. which is the value immediately before operation of the thermally responsive element 16, a force, which is the reaction force of the contact pressure between the movable and fixed contacts, acts on the fixing strip 19. However, the stiffness of the fixing strip 19 is determined to take such a large value so that the fixing strip 19 is not influenced by the reaction force in the above-mentioned temperature range. Consequently, the contact pressure between the male screw 12 and the fixing strip 19 is not changed and accordingly, the electrical contact resistance therebetween is not changed. Furthermore, the fixing strip 19 is rigidly secured to the thermally responsive element support 7 and the thermally responsive element 16 by way of welding which does not cause variations in the electrical resistance. The male screw 12 of the calibration mechanism 8 is in contact with the slender clamping portions 14, 15 and the lower end of the screw is in contact with the fixing strip 19 with a certain contact resistance. Consequently, the amount of current bypassed into the calibration mechanism 8 side can be made small as compared with the amount of current flowing into the fixing strip 19, which can provide a further stable current-operating time characteristic. When the thermally responsive element 16 is cooled and the temperature thereof is reduced, for example, to 80° C. after the reversion of its curvature with snap action, it automatically reverses its curvature shown by a solid line in FIG. 1 with snap action such that the movable contact 16a is brought into contact with the fixed contact 21a.

Figure 6:
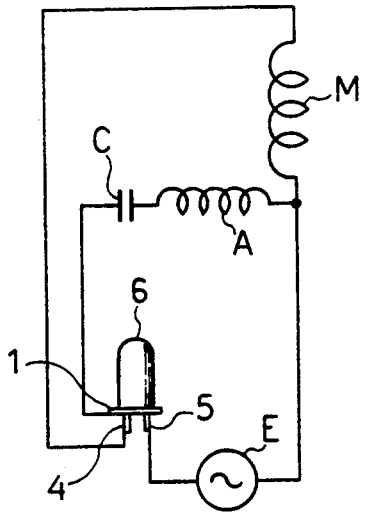
FIG. 6 is an electrical wiring diagram for explaining the use of the thermally responsive switch in which a heater is employed.

In the foregoing embodiment shown in FIGS. 1-5, the current-operating time characteristic can be caused to differ between the case where the electricity is supplied across the terminals 4, 5 and the case where electricity is supplied across the header plate 1 and the terminal pin 5. More specifically, in the latter case, the current-operating time characteristic can be desirably set by rendering the resistance value of the heater 22 larger than the internal resistance value of the thermally responsive switch in the former case. Therefore, the thermally responsive switch of the foregoing embodiment is suitable for a single-phase induction motor having a main winding M and an auxiliary winding A, as schematically shown in FIG. 6. Now, consider a starting or operating condition when an abnormal current flows into each of the main and auxiliary windings M, A when a capacitor C is connected in series with the auxiliary winding A. When the current-operating time characteristics of the thermally responsive switch need to differ with respect to the main and auxiliary windings M, A, a reliable motor protecting characteristic can be attained when the thermally responsive switch is connected relative to a power source E as shown in FIG. 6. More specifically, the total amount of current flowing into the main and auxiliary windings M, A flows through the terminal pin 5, the second support 21, fixed contact 21*a*, movable contact 16*a*, thermally responsive element 16 and fixing strip 19 into the first support 7. The current branches at the first support 7. The current supplied to the main winding M flows through the terminal pin 4 from the first support 7 and the current supplied to the auxiliary winding A flows through the heater 22 and header plate 1 from the first support 7. Generally, the temperature is increased more rapidly when an overcurrent flows into the auxiliary winding A. Therefore, the resistance value of the heater 22 is determined in consideration of such a rapid temperature increase so that the motor is protected against the overcurrent. This arrangement is particularly effective when starting relay contacts are melted because of some failure to thereby cling to each other in the case where a starting capacitor with a large capacity is connected in parallel with the capacitor C via a starting relay contact.

Conditions other than the above-described, abnormal conditions of the motor include a locked-rotor condition in which load torque exceeds starting torque at starting and a condition when persistence of the overcurrent condition for a long period during the running of the motor gradually raises the winding temperature, resulting in damage to the winding insulation. To cope with the locked-rotor condition, the resistance values of the thermally responsive element 16, fixing strip 19 and second support 21 are determined in accordance with a large phase current in designing the thermally responsive switch. Against the slow temperature increase due to a long period of overcurrent condition, the air atmosphere of in the housing 6 may be replaced by helium atmosphere of so that the winding temperature readily transfers to the thermally responsive element 16.

Figure 7:
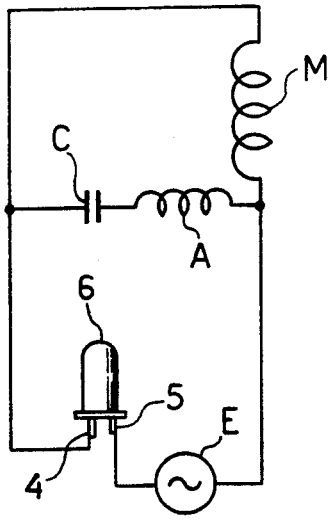
FIG. 7 is a view similar to FIG. 6 showing the thermally responsive switch of a second embodiment of the invention in which a heater is not employed.

When the temperature increase in the motor main and auxiliary windings M, A is not particularly disadvantageous for the auxiliary winding A, the wiring may be simplified as shown in FIG. 7 as another embodiment of the invention. Furthermore, the heater 22 employed in each embodiment may be eliminated.

Figure 8:
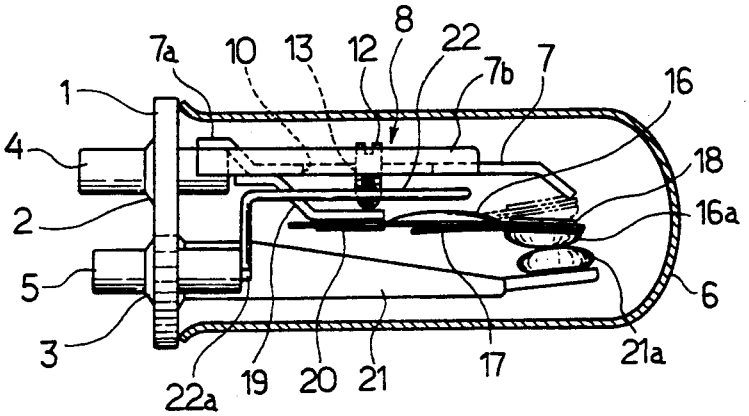
FIG. 8 is a side view of the thermally responsive switch of a third embodiment of the invention.

Although the second or fixed contact support 21 is secured to the terminal pin 5 in the foregoing embodiments described with reference to FIGS. 1–7, the second support may be secured to the header plate 1 and the end 22*a* of the heater 22 may be connected to the terminal pin 5, as in another embodiment shown in FIG. 8. When the heater 22 is not necessary in this case, the terminal pin 5 may be eliminated.

Figure 9:
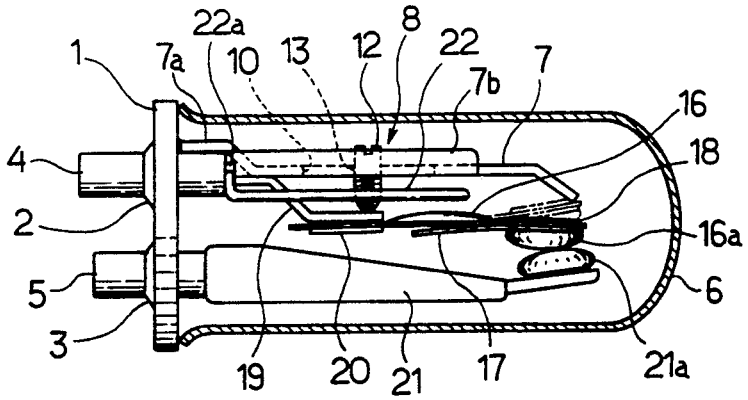
FIG. 9 is a side view of the thermally responsive switch of a fourth embodiment of the invention.

Although the first or thermally responsive element support 7 is secured to the terminal pin 4 in the foregoing embodiments described with reference to FIGS. 1–7, the first support 7 may be secured to the header plate 1 and the end 22*a* of the heater 22 may be connected to the terminal pin 4, as shown in a further embodiment in FIG. 9. In this case, too, the terminal pin 4 may be eliminated when the heater 22 is not used.

The foregoing disclosure and drawings are merely illustrative of the principles of the present invention and are not to be interpreted in a limiting sense. The only limitation is to be determined from the scope of the appended claims.

We claim:

1. A thermally responsive switch comprising:

a) a header plate formed of an electrically conductive material and having two openings through each of which a respective terminal pin of a pair of terminal pins is extended and secured therein with an insulating material inserted therebetween;

b) a first support formed of an electrically conductive material having a predetermined stiffness and secured to one terminal pin of said terminal pins;

c) a fixing strip formed of an electrically conductive material having a predetermined stiffness and having two ends, one end of which is secured to the vicinity of a portion of said first support secured to said one terminal pin;

d) a thermally responsive element secured at one end of two ends thereof to another end of said fixing strip in a cantilever relation, said thermally responsive element having a generally central dish-shaped portion moving in a snap action when subjected to heat, said thermally responsive element carrying a movable contact at another end thereof;

e) a second support secured to another terminal pin of said terminal pins and having a fixed contact secured thereto and engaged with and disengaged from said movable contact; and f) a calibration mechanism comprising a screw, an aperture formed in said first support, said aperture having a diameter smaller than an outer diameter of said screw, and clamping portions elastically clamping said screw when said screw is screwed into said aperture and against said fixing strip, said fixing strip having a stiffness so determined that variations in a ratio of a first current bypassed into said calibration mechanism to a second current flowing through said fixing strip and said thermally responsive element are negligible.

2. A thermally responsive switch according to claim 1, which further comprises a heater having two ends, one end of said heater being secured to a vicinity of a portion of said first support secured to said one terminal pin, a second end of said heater being connected to said header plate.

3. A thermally responsive switch comprising:

a) a header plate formed of an electrically conductive material and having an opening through which a first terminal pin is extended and secured therein with an insulating material inserted therebetween;

b) a first support formed of an electrically conductive material having a predetermined stiffness and secured to said first terminal pin;

c) a fixing strip formed of an electrically conductive material having a predetermined stiffness and having two ends, one end of which is secured to a vicinity of a portion said first support secured to said first terminal pin;

d) a thermally responsive element secured at one of two ends to a second end of said fixing strip in a cantilever relation, said thermally responsive element having a generally central dish-shaped portion moving in a snap action when subjected to heat, said thermally responsive element carrying a movable contact at a second end thereof;

e) a second support secured to a second terminal pin and having a fixed contact secured thereto and engaged with and disengaged from said movable contact; and f) a calibration mechanism comprising a screw, an aperture formed in said first support and having a diameter smaller than an outer diameter of said screw, and clamping portions elastically clamping said screw when said screw is screwed into said aperture and against said fixing strip said fixing strip having a stiffness so determined that the variations in a ratio of a current bypassed into said calibration mechanism to a current flowing through said fixing strip and said thermally responsive element are negligible.

4. A thermally responsive switch according to claim 3, wherein said header plate has an additional opening through which said second terminal pin is extended and secured therein with an insulating material inserted therebetween, and a heater is connected at one of two ends thereof to a vicinity of a portion of said first support secured to said first terminal pin and at another end thereof to said second terminal pin.

5. A thermally responsive switch comprising:

a) a header plate formed of an electrically conductive material and having an opening through which a first terminal pin is extended and secured therein with an insulating material inserted therebetween;

b) a first support formed of an electrically conductive material having a predetermined stiffness and secured to said header plate;

c) a fixing strip formed of an electrically conductive material having a predetermined stiffness and having two ends, one of which is secured to a vicinity of a portion of said first support secured to said header plate;

d) a thermally responsive element secured at one of two ends thereof to another end of said fixing strip in a cantilever relation, said thermally responsive element having a generally central dish-shaped portion moving in a snap action when subjected to heat, said thermally responsive element carrying a movable contact at another end thereof, e) a second support secured to said first terminal pin and having a fixed contact secured thereto and engaged with and disengaged from said movable contact; and f) a calibration mechanism comprising a screw, an aperture formed in said first support and having a diameter smaller than an outer diameter of said screw, and clamping portions elastically clamping said screw when said screw is screwed into said aperture and against said fixing strip, said fixing strip having a thickness so determined that variations in a ratio of a current bypassed into said calibration mechanism to a current flowing through said fixing strip and said thermally responsive element are negligible.

6. A thermally responsive switch according to claim 5, wherein the header plate has an additional opening through which an additional terminal pin is extended and secured therein with an insulating material inserted therebetween, said first support is secured to said additional terminal pin of said terminal pins, and a heater is connected at one of two ends thereof to a vicinity of a portion of said first support secured said additional terminal pin and at another end thereof to said first terminal pin.

* * * * *